US008317897B2

(12) United States Patent
Beaudoin

(10) Patent No.: US 8,317,897 B2
(45) Date of Patent: Nov. 27, 2012

(54) METHOD FOR SUPERSONICALLY INJECTING OXYGEN INTO A FURNACE

(75) Inventor: Philippe Beaudoin, Guyancourt (FR)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 697 days.

(21) Appl. No.: 12/092,906

(22) PCT Filed: Oct. 23, 2006

(86) PCT No.: PCT/FR2006/051080

§ 371 (c)(1),
(2), (4) Date: May 7, 2008

(87) PCT Pub. No.: WO2007/057588

PCT Pub. Date: May 24, 2007

(65) Prior Publication Data

US 2008/0277843 A1 Nov. 13, 2008

(30) Foreign Application Priority Data

Nov. 10, 2005 (FR) ..... 05 53430

(51) Int. Cl.
*C21B 7/16* (2006.01)
*C21B 5/00* (2006.01)

(52) U.S. Cl. ..... 75/466; 75/458; 75/459; 75/463; 266/44; 266/47; 266/216; 266/217; 266/218; 266/225; 266/265; 373/79; 373/115; 373/142

(58) Field of Classification Search ..... 75/458–459, 75/463, 466; 266/44, 47, 216–218, 225, 266/265; 373/79, 115, 142
See application file for complete search history.

(56) References Cited

U.S. PATENT DOCUMENTS

| | | | |
|---|---|---|---|
| 4,324,583 | A | 4/1982 | Hamilton |
| 5,946,340 | A | 8/1999 | Ramthun et al. |
| 2007/0137436 | A1 | 6/2007 | Loffler |

FOREIGN PATENT DOCUMENTS

| | | |
|---|---|---|
| DE | 101 17 962 | 10/2002 |
| DE | 102 49 235 | 5/2004 |
| FR | 2 822 939 | 10/2002 |

OTHER PUBLICATIONS

PCT Written Opinion of the ISA, English Translation, for PCT/FR2006/051080.
Bosch, et al.; "Controlled supersonic injection of oxygen," Foundry Trade Journal, Jan./Feb. 2004, vol. 178, No. 3611, pp. 18-19.
International Search Report for PCT/FR2006/051080.

*Primary Examiner* — Lois Zheng
(74) *Attorney, Agent, or Firm* — Christopher J. Cronin

(57) ABSTRACT

The invention relates to a method and device for supersonically injecting oxygen into a furnace, in particular a cupola furnace, in which the total oxygen required for the furnace operation is injected with the aid of two distinct circuits, i.e., the first circuit comprising at least one supersonic oxygen injecting nozzle and a second circuit which comprises additionally oxygen injecting means and is connected to the first circuit by pressure-sensitive means, such as a discharging device (or upstream pressure adjuster), in such a way that a stable pressure is obtained in the first circuit upon the attainment of the maximum flowrate thereof, wherein the first circuit can consists of several supersonic nozzle groups.

19 Claims, 3 Drawing Sheets

METHOD FOR SUPERSONICALLY INJECTING OXYGEN INTO A FURNACE

This application is a §371 of International PCT Application PCT/FR2006/051080, filed Oct. 23, 2006.

BACKGROUND

1. Field of the Invention

The present invention relates to a method for super-sonically injecting oxygen into a melting furnace, especially a shaft furnace, in which the raw materials such as coke and scrap iron are loaded through the top and in which the combustion of the combustible materials is carried out by injecting air, generally preheated air, which reacts with the coke, the combustion having been initiated using preheated burners. These furnaces are especially cupola furnaces which comprise a toric annulus placed at the base of the cupola into which the blast air, preheated by heat exchange with the combustion gases, is injected through a multitude of nozzles connected to this toric annulus.

2. Related Art

To improve the operation of cupola furnaces, or to increase their production, it is known to inject oxygen by means of supersonic lances positioned in the center of each nozzle. One of the advantages of this technology is the penetration of oxygen into the center of the cupola due to the high oxygen injection velocity.

However, in the case of a low oxygen flow rate, the pressure of the oxygen in the lances decreases, this results in a decrease in the velocity of the oxygen injected into the cupola, (a velocity which becomes subsonic), the penetration of oxygen into the center of the cupola then being lower than at a high oxygen flow rate (with an upstream pressure of around 8 to $10\times10^5$ Pa in the case of the cupola).

In order to obtain a high oxygen velocity, the lances are generally sized for a working pressure of around $9\times10^5$ Pa (upstream of the convergent/divergent device that forms the supersonic injection nozzle positioned at the end of the lance). However, this pressure is only obtained at the nominal flow rate of the installation: it is only $4.5\times10^5$ Pa when operating at 60% of the nominal value.

To overcome this problem, it has already been proposed to make all the lances operate alternately either by alternating the "start" and "stop" regimes, or by alternating a "low flow rate" with a "high flow rate". In both cases, the maximum flow rate is obtained at the working pressure of the lances. Thus, the lances are stopped from operating at low pressure which results in a low oxygen injection velocity.

These known techniques have, however, the following drawbacks:

- complexity of implementation (installation cost);
- reliability of solenoid valves subjected to a very large number of opening/closing cycles;
- knowledge of the average flow rate consumed is difficult to establish, which does not facilitate comparison of these techniques relative to a stable flow rate; and
- control of the overall flow rate is not continuous, but is in increments of flow rate.

One alternative consists in operating an increasing number of lances, as a function of the flow rate in order to maintain the most stable pressure possible in the lances. Thus the low operating pressures are avoided when the oxygen flow rate is low.

However, there is generally an oxygen injection dissymmetry that is prejudicial to the correct operation of the cupola.

In all the case, the solutions described above require, in addition, the installation of an additional motor control.

SUMMARY OF THE INVENTION

The method and the device according to the invention make it possible to avoid these drawbacks. The method of the invention is characterized in that the total oxygen required for the furnace operation is injected using two separate circuits:

- a first circuit comprising at least one supersonic oxygen injection nozzle; and
- a second circuit comprising additional oxygen injection means, the second circuit being connected to the first circuit by pressure-sensitive means, such as an overflow (or more generally upstream pressure regulating means), so as to obtain a stable oxygen pressure in the first circuit as soon as the maximum flow rate of this first circuit is attained.

In the first circuit, positioned inside each nozzle is a supersonic lance, the dimensions of which are provided for operating at the optimum pressure that gives the maximum oxygen velocity (i.e. 9 bar relative for a velocity of around Mach 2.1), this pressure being attained for a fraction of the total maximum flow rate.

In the second circuit, the additional oxygen for attaining the total flow rate is injected. This second circuit will inject the oxygen into the cupola through a second injection point, different from the injection point of the supersonic lances. The injection velocity over this second circuit will be lower, but the usage time of this second circuit will be low compared to the usage time of the first circuit.

Preferably, this second circuit will be directly fed by a "branch connection" in the first circuit by means of an overflow (or a pressure regulator placed upstream of the supersonic nozzle).

Thus, the pressure in the first circuit will be stable as soon as the maximum flow rate of the first circuit is attained.

Preferably, the first circuit is sized so as to obtain a supersonic oxygen injection velocity as soon as a fraction, for example 60 vol %, of the maximum total oxygen flow rate is attained. According to one embodiment variant, the method of the invention is characterized in that the oxygen from the second circuit is injected into the blast air of the cupola or concentrically around the supersonic oxygen jet or directly into at least one of the blast-air injection nozzles, preferably at a subsonic velocity.

The invention also relates to a device for implementing this method characterized in that it comprises means for injecting oxygen, having a maximum flow rate, a first circuit comprising at least one supersonic oxygen injection nozzle, a second circuit for additional oxygen injection, the first and second circuits being connected to the oxygen injection means, pressure-sensitive means, such as an overflow (or an upstream pressure regulator), being interposed between the oxygen injection means of the first circuit and of the second circuit.

Also preferably, the first circuit comprises a plurality of groups of at least one oxidant injection lance, each lance group being activated successively in order to maintain a supersonic injection of oxidant into the first circuit while the oxidant flow rate of the first circuit is increasing.

BRIEF DESCRIPTION OF THE FIGURES

The invention will be better understood with the aid of the following exemplary embodiments, given non-limitingly, together with the figures that represent.

DETAILED DESCRIPTION OF THE INVENTION

Figure 1:
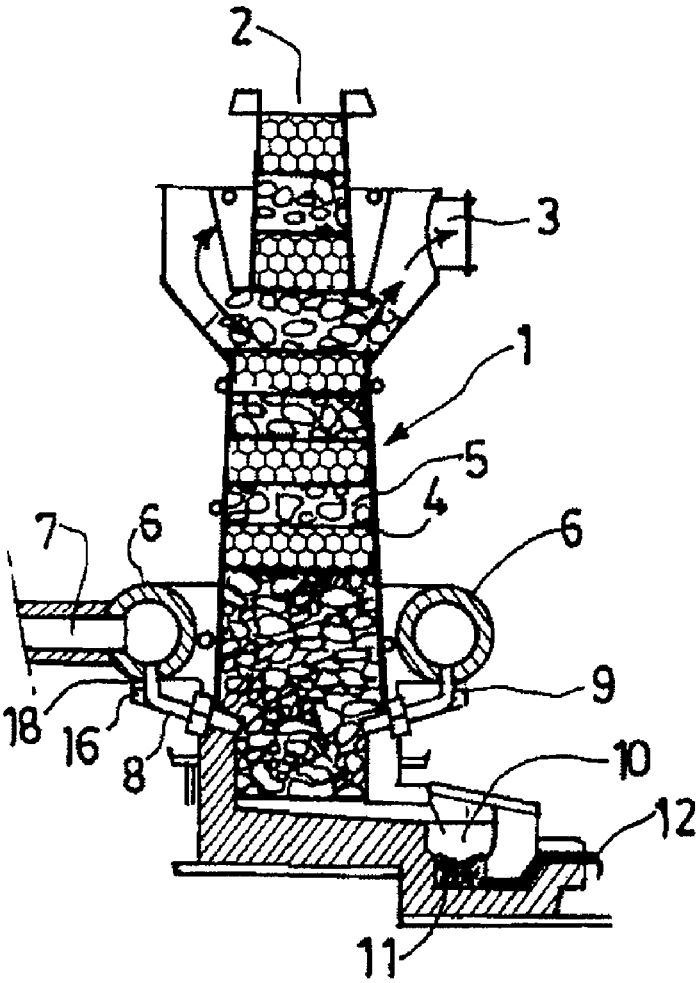
FIG. 1, a diagram of a cupola and of its oxidant (hot blast air) supply system according to the prior art.

FIG. 1 represents a diagram of a cupola 1 according to the prior art. The metallic substances 5, the coke 4, etc. are introduced through the opening 2 (in successive layers) located at the top of this cupola. Near to the top 2 is a circuit 3 for recovering hot gases.

The air belt 6 is supplied through 7 with air preheated by contact with the flue gases from 3, the blast air being distributed through ducts, such as 18 having a plurality of nozzles such as 8 and 9 in the bottom part of the blast furnace. The molten metal is recovered in 11, then 12, whereas the slag is recovered in 10.

Figure 2:
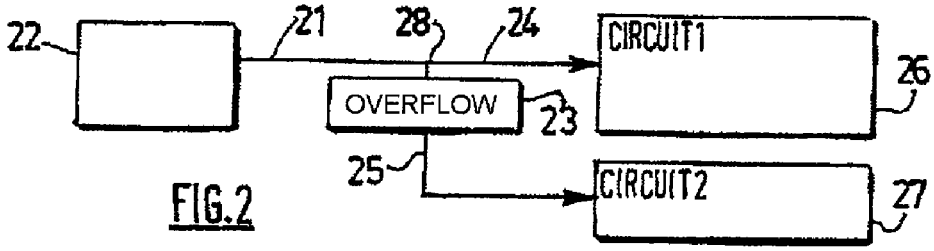
FIG. 2, a block diagram for injection of oxidant according to the invention.

FIG. 2 represents a block diagram of the system according to the invention. The total oxygen flow rate 21 is controlled by flow rate regulating means 22, so as to obtain an oxygen (vol.) enrichment of X % of the hot blast air from the cupola. The first circuit (26) corresponds to the supersonic oxygen injection circuit. The second circuit (27) corresponds to the low-velocity, additional oxygen flow rate circuit.

Downstream of point 28, is the first circuit 26 for injecting oxygen 24: circuit 1 is supplied with oxygen, the maximum pressure of $9\times10^5$ Pa is attained with a maximum flow rate Q1 as a function of the diameter of the supersonic nozzles positioned at the end of the lances. (Q1=flow rate of each lance× number of lances).

The second circuit 27 is also here, connected to the common point 28 via an overflow 23 (controlled, for example, for an upstream pressure of 9 bar) and a duct 25.

This second circuit makes it possible to supplement the oxygen flow rate required for the cupola operation above the flow rate Q1.

In the example from FIG. 2, the circuit 26 injects oxidant through supersonic lances. The dimensions are provided for operating at the optimum pressure that gives the maximum oxygen velocity (i.e. 9 bar relative for a velocity of around Mach 2.1).

Figure 3:
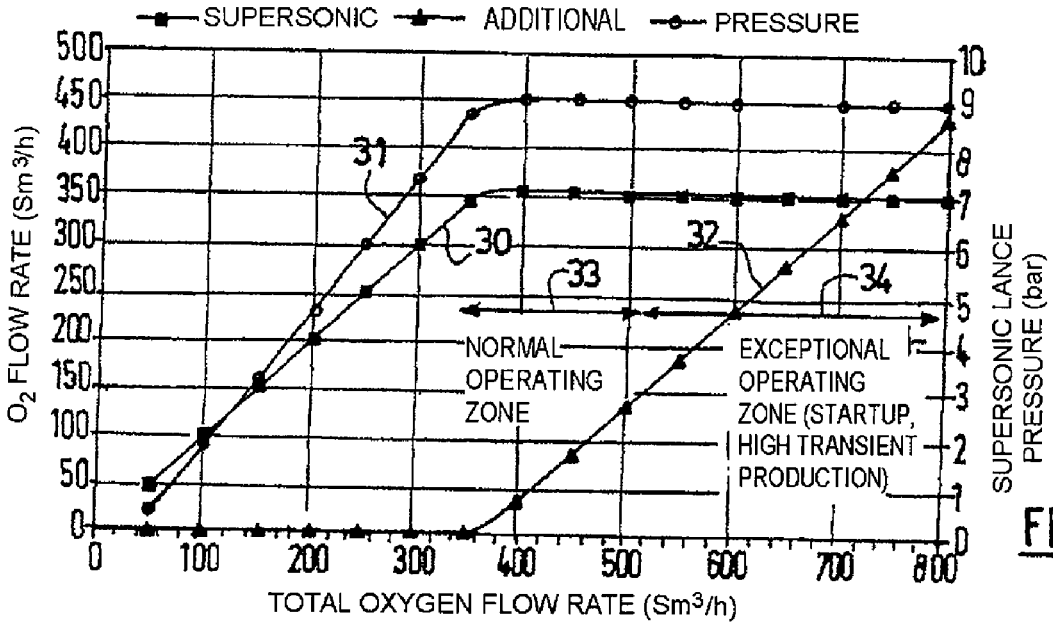
FIG. 3, the flow rate curves of the oxidant in the various circuits.

FIG. 3 illustrates the distribution of the flow rates between the first (supersonic) circuit and the second (additional) circuit and also the change in pressure in the supersonic lances. The pressure of 9 bar is attained as soon as the flow rate of 360 $Sm^3/h$ is attained (flow rate determined by the choice of the supersonic injector size).

The cupola furnace with hot blast air operates optimally when the production and operating parameters are stable. Thus, the consumption of oxygen is generally stabilized.

The oxygen flow rate may be increased temporarily during restarting or during an occasional increase in production, generally for relatively short durations.

With the system of supersonic lances that operate continuously, the lances are sized for the maximum flow rate. In the general case of stabilized operation, the velocity of the oxygen is much lower than anticipated with the supersonic system. (Throughout the text, except in particular cases, the term "oxygen" denotes an oxidant in general, that is to say commonly a gas containing at least 21 vol % of oxygen up to 100 vol % of pure oxygen).

In the system according to the invention, the velocity of the oxygen injected is supersonic as soon as a significant fraction of the flow rate is attained (for example, 60% of the maximum flow rate). Above this flow rate, the additional oxygen is diverted toward the second injection circuit, this second circuit only being used transiently: the fact of having a lower velocity, and therefore a reduced effectiveness of this fraction of the oxygen flow rate, becomes secondary faced with the advantage of continuously injecting 60% (in the case of exceptional operation) or 90 to 100% (in the case of normal operation) of the oxygen flow rate used at very high velocity.

This solution has the advantage of a simple implementation and complete transparency for the operator who can still control the total flow rate of oxygen continuously.

Furthermore, no additional motor control is introduced.

The curve 30 represents the oxygen flow rate in the first circuit in the form of supersonic injection. This flow rate reaches a maximum toward 350 $Sm^3/h$ that corresponds to the maximum pressure attained in 21, i.e. around $9\times10^5$ Pa (curve 31 is in bar with around 1 bar equal to $10^5$ Pa). The increase in the flow rate (curve 32) is then achieved via circuit 2 (27).

Thus, defined in FIG. 3 is a zone of "normal" operation 33 (supersonic injection of oxygen via 26) and a zone of exceptional operation 34 that corresponds to the startup of the installation, to a high transient production, etc. via the circuits 26 and 27.

Figure 4:
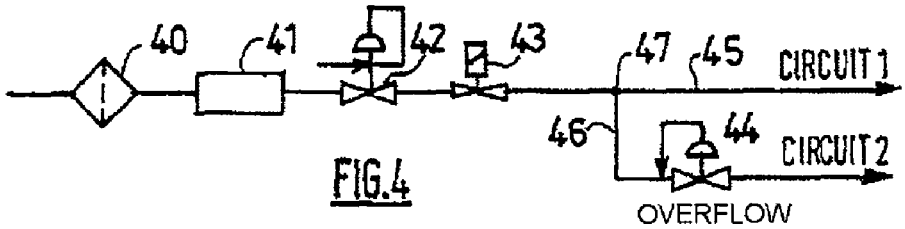
FIG. 4, an exemplary embodiment of FIG. 2.

FIG. 4 describes an example of implementing the block diagram from FIG. 2.

The oxidant passes successively through a filter 40, a flow meter 41, a safety valve 42, a metering valve 43, the outlet of which is connected to the point 47 where the ducts 45 for the first circuit (26) and 46 for the second circuit (27) which supplies the overflow 44, separate.

Figure 5:
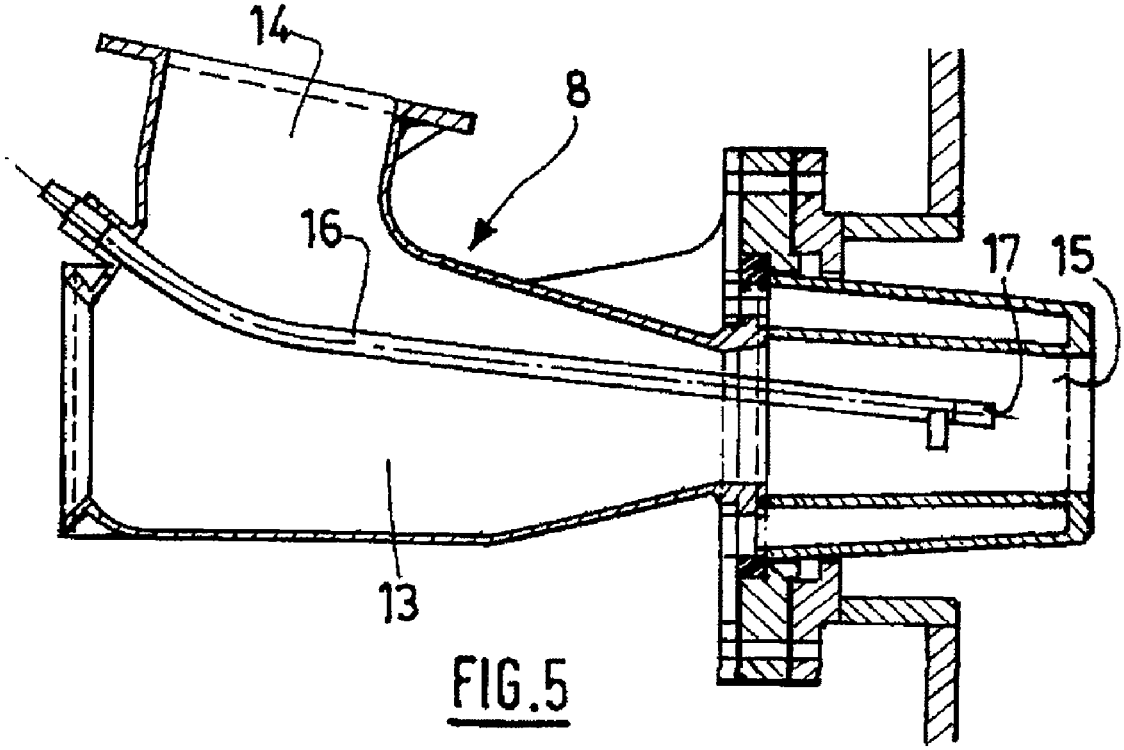
FIG. 5, a schematic cross-sectional view of an oxidant injection nozzle and its supersonic oxygen injection system.

FIG. 5 is a cross-sectional view of the injection nozzle 8, modified according to the invention.

The oxygen duct 16 passes through the jet of hot blast air 13 coming from 14 in order to terminate in the vicinity of the end of the nozzle 15 via a (convergent/divergent) supersonic injection nozzle 17.

Figure 6:
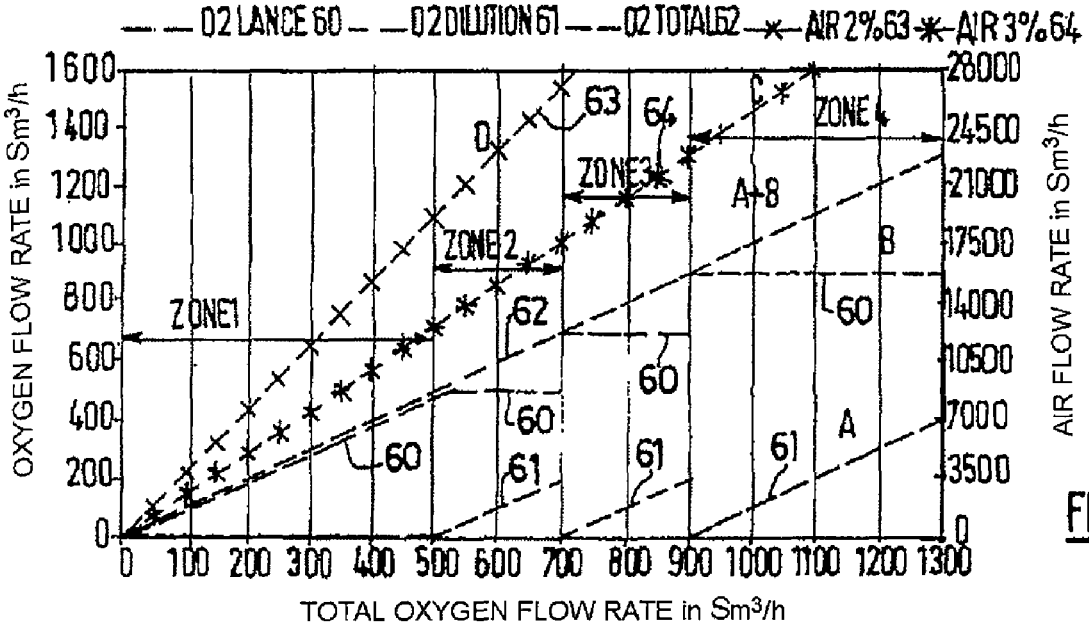
FIG. 6, the oxidant flow rate curves in a multi-lance system operating in increments.

FIG. 6 illustrates the distribution of the flow rate between the first circuit 26 and the second circuit 27, in the case where the first circuit 26 is composed of three groups of lances with successive opening of the groups in flow rate increments.

In order to increase the flexibility of the technique, use is made of n groups of lances (for example, three groups of lances) that open one after the other as explained below. Above the maximum flow rate of the first group of lances, the operation of the lances (circuit 1) in service will always be supersonic.

Circuit 2 injects oxidant in dilution into the blast air of the additional flow rate A (difference between the total flow rate A+B and the flow rate of the lances in service B). The oxidant injection velocity of this second circuit is lower, but the fraction of flow rate of this second circuit is low (15% on average).

Circuit 2 is directly supplied by a branch connection in circuit 1 by means of an overflow. Thus, the pressure in circuit 1 is stable as soon as the maximum flow rate of the first group of lances is attained.

In the example from FIG. 6, the various zones numbered 1 to 4 correspond to the following operation:

Non-supersonic operation (flow rate of less than 500 $Sm^3/h$)

Zone 1: first group of lances and zero flow rate in circuit 2.

Supersonic operation (flow rate between 500 and 1100 $Sm^3/h$).

Zone 2: first group of lances, curve 60 (hold) then flow rate in circuit 2 (ramp 61 in the figure) which in total gives the flow rate A+B (ramp 62 in the figure) from FIG. 6.

Zone 3: the first and second groups of lances of circuit 1 operate, to which is added a flow rate in the form of a ramp (61) in circuit 1. When, in zone 3, the constant flow rate of circuit 1 (60) and increasing flow rate of circuit 2 (61) have attained 900 $Sm^3/h$, then the third group of supersonic lances is activated, the flow rate of circuit 2 returns to zero and one is then in zone 4 again.

Zone 4: the three groups of lances of circuit 1 are activated, with an increasing flow rate in circuit 2. (The curves 64 and 63 (or C and D) represent the air flow rate of the blast air enriched respectively with 3 vol % and 2 vol % of oxygen).

The air flow rate corresponding to an enrichment of 2% (curve D) and 3% (curve C) is given in FIG. 6. An enrichment of 3% makes it possible to decrease the amount of coke. Compared to the operation according to the prior art, the air flow rate is reduced by 10 to 15%, this drop being compensated for by the additional oxygen flow rate and the reduction in the coke flow rate.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for supersonically injecting an oxidant into a furnace, wherein total oxidant required for furnace operation is injected using at least two separate circuits:

a first circuit comprising at least one supersonic oxidant injection nozzle; and a second circuit comprising additional oxidant injection means, the second circuit being connected to the first circuit by pressure-sensitive means that is controlled to an upstream pressure that is reached when a maximum flow rate of this first circuit is attained, wherein when the reached pressure is exceeded, the additional oxidant corresponding to the exceeded pressure is diverted to the second circuit so as to obtain a stable oxidant pressure in the first circuit.

2. The method of claim 1, wherein the pressure-sensitive means is an upstream pressure regulator.

3. The method of claim 1, wherein the first circuit comprises a plurality of groups of at least one oxidant injection lance, each additional lance group being activated successively while already activated lance groups remain activated in order to maintain a supersonic injection of oxidant into the first circuit while a flow rate of the oxidant of the first circuit is increasing.

4. The method of claim 1, wherein the oxidant from the second circuit is injected into blast air of the cupola or concentrically around the at least one supersonic oxidant injection nozzle or directly into at least one blast-air injection nozzles.

5. The method of claim 4, wherein the oxidant from the second circuit is injected at a subsonic velocity.

6. The method of claim 1, wherein the oxidant comprises a gas containing 21 to 100 vol % of oxygen.

7. The method of claim 6, wherein the furnace is a cupola furnace.

8. The method of claim 6, wherein the first circuit is sized so as to obtain a supersonic oxidant injection velocity as soon as a fraction of a maximum total oxidant flow rate injected using said at least two separate circuits is attained.

9. The method of claim 8, wherein the fraction is 60 vol %.

10. The method of claim 8, wherein the furnace is a cupola furnace.

11. The method of claim 10, wherein the oxidant from the second circuit is injected into blast air of the cupola or concentrically around the at least one supersonic oxidant injection nozzle or directly into at least one blast-air injection nozzle.

12. The method of claim 11, wherein the oxidant from the second circuit is injected at a subsonic velocity.

13. A method for supersonically injecting oxygen into a cupola furnace, wherein total oxygen required for furnace operation is injected using at least two separate circuits:

a first circuit comprising at least one supersonic oxygen injection nozzle; and a second circuit comprising additional oxygen injection means, the second circuit being connected to the first circuit by pressure-sensitive means that is controlled to an upstream pressure that is reached when a maximum flow rate of this first circuit is attained, wherein when the reached pressure is exceeded, the additional oxidant corresponding to the exceeded pressure is diverted to the second circuit so as to obtain a stable oxidant pressure in the first circuit.

14. The method of claim 13, wherein the first circuit comprises a plurality of groups of at least one oxygen injection lance, each additional lance group being activated successively while already activated lance groups remain activated in order to maintain a supersonic injection of oxygen into the first circuit while a flow rate of the oxygen of the first circuit is increasing.

15. The method of claim 13, wherein the oxygen from the second circuit is injected into blast air of the cupola or concentrically around the at least one supersonic oxygen injection nozzle or directly into at least one blast-air injection nozzles.

16. The method of claim 15, wherein the oxygen from the second circuit is injected at a subsonic velocity.

17. The method of claim 13, wherein the first circuit is sized so as to obtain a supersonic oxygen injection velocity as soon as a fraction of a maximum total oxygen flow rate injected using said at least two separate circuits is attained.

18. The method of claim 17, wherein the oxygen from the second circuit is injected into blast air of the cupola or concentrically around the at least one supersonic oxygen injection nozzle or directly into at least one blast-air injection nozzle.

19. The method of claim 18, wherein the oxygen from the second circuit is infected at a subsonic velocity.

* * * * *